US008887524B2

(12) United States Patent
Mihara

(10) Patent No.: US 8,887,524 B2
(45) Date of Patent: Nov. 18, 2014

(54) REFRIGERATING APPARATUS

(75) Inventor: Kazuhiko Mihara, Gunma (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 1442 days.

(21) Appl. No.: 12/279,387

(22) PCT Filed: Mar. 15, 2007

(86) PCT No.: PCT/JP2007/055216
§ 371 (c)(1),
(2), (4) Date: Aug. 14, 2008

(87) PCT Pub. No.: WO2007/119372
PCT Pub. Date: Oct. 25, 2007

(65) Prior Publication Data

US 2009/0205355 A1 Aug. 20, 2009

(30) Foreign Application Priority Data

Mar. 29, 2006 (JP) ..... 2006-090402
Mar. 29, 2006 (JP) ..... 2006-090403

(51) Int. Cl.
*F25B 1/00* (2006.01)
*F25B 40/00* (2006.01)
*F25B 9/00* (2006.01)

(52) U.S. Cl.
CPC ..... *F25B 9/008* (2013.01); *F25B 2400/23* (2013.01); *F25B 1/00* (2013.01); *F25B 2309/061* (2013.01); *F25B 2600/2513* (2013.01); *F25B 2400/04* (2013.01); *F25B 40/00* (2013.01); *F25B 2400/13* (2013.01); *F25B 2400/0409* (2013.01)
USPC ..... 62/498

(58) Field of Classification Search
CPC ..... F25B 2400/04; F25B 2600/24513; F25B 2400/23; F25B 2400/0409
USPC ..... 62/114, 117, 160, 183, 222, 238.6, 62/324.1, 498, 509, 513, 196.1, 197, 208, 62/216–217, 226, 228.1, 228.3, 228.5, 62/502, 510, 512, 174, 515, 473
See application file for complete search history.

(56) References Cited

U.S. PATENT DOCUMENTS 933,682 A * 9/1909 Voorhess ..... 62/219
4,562,700 A * 1/1986 Atsumi et al. ..... 62/174

(Continued)

FOREIGN PATENT DOCUMENTS

JP 06-034206 2/1994
JP 9-229497 9/1997

(Continued)

OTHER PUBLICATIONS

International Search Report for International Application No. PCT/JP2007/055216 dated Jun. 14, 2007.

(Continued)

*Primary Examiner* — Frantz Jules
*Assistant Examiner* — Emmanuel Duke
(74) *Attorney, Agent, or Firm* — Kratz, Quintos & Hanson, LLP.

(57) ABSTRACT

A refrigerating circuit in which a compressor, a gas cooler, a first pressure reducing unit and an evaporator are successively annularly connected to one another via pipes includes a second pressure reducing unit and a liquid receiver between the gas cooler and the first pressure reducing unit, and the liquid receiver is connected to the suction port of the compressor via a pipe. Then, the opening/closing degree of the second pressure reducing unit is controlled in accordance with a pressure difference between the discharge-side pressure of the compressor and the suction-side pressure thereof, whereby the amount of the refrigerant to be circulated is increased when the refrigerating ability runs short, and the excessive refrigerant is received in the liquid receiver when the refrigerating ability becomes excessive, so that the amount of the refrigerant to be circulated can be adjusted.

11 Claims, 11 Drawing Sheets

(56) References Cited

U.S. PATENT DOCUMENTS

| | | | | | |
|---|---|---|---|---|---|
| 4,622,829 | A | * | 11/1986 | Okada | 62/216 |
| 5,056,328 | A | * | 10/1991 | Jaster et al. | 62/180 |
| 5,056,329 | A | * | 10/1991 | Wilkinson | 62/197 |
| 5,191,776 | A | * | 3/1993 | Severance et al. | 62/513 |
| 5,197,297 | A | * | 3/1993 | Brendel et al. | 62/81 |
| 5,224,354 | A | * | 7/1993 | Ito et al. | 62/210 |
| 5,372,013 | A | * | 12/1994 | Lau et al. | 62/174 |
| 5,465,591 | A | * | 11/1995 | Cur et al. | 62/439 |
| 5,752,391 | A | * | 5/1998 | Ozaki et al. | 62/228.1 |
| 5,829,262 | A | * | 11/1998 | Urata et al. | 62/174 |
| 6,694,760 | B2 | * | 2/2004 | Hirota et al. | 62/181 |
| 6,923,011 | B2 | * | 8/2005 | Manole | 62/149 |
| 2004/0206098 | A1 | * | 10/2004 | Takano et al. | 62/174 |
| 2005/0132729 | A1 | * | 6/2005 | Manole | 62/149 |
| 2005/0204773 | A1 | * | 9/2005 | Imai et al. | 62/512 |
| 2006/0032267 | A1 | * | 2/2006 | Kamimura et al. | 62/498 |

FOREIGN PATENT DOCUMENTS

| | | | | | |
|---|---|---|---|---|---|
| JP | 10-115470 | | * | 5/1998 | F25B 1/00 |
| JP | 10115470 | | * | 5/1998 | F25B 1/00 |
| JP | 2000-346466 | | * | 12/2000 | |
| JP | 2000337722 | | * | 12/2000 | F25B 1/00 |
| JP | 2000346466 | | * | 12/2000 | F25B 1/00 |
| JP | 2001-116376 | | * | 4/2001 | F25B 1/00 |
| JP | 2001116376 | | * | 4/2001 | F25B 1/00 |
| JP | 2001-317820 | | | 11/2001 | |
| JP | 2002-106959 | | | 4/2002 | |
| JP | 2002-106960 | A1 | | 4/2002 | |
| JP | 2003-4316 | A1 | | 1/2003 | |
| JP | 2004-279014 | A1 | | 10/2004 | |
| JP | 2005-257149 | A1 | | 9/2005 | |
| JP | 2005-351494 | A1 | | 12/2005 | |

OTHER PUBLICATIONS

Japanese Office Action dated Feb. 1, 2011 in JP Appln. No. 2006-090402 (in Japanese).

Japanese Office Action dated Feb. 1, 2011 in JP Appln. No. 2006-090403 (in Japanese).

Japanese Office Action dated Jan. 11, 2011 in JP Appln. No. 2008-086108 (in Japanese).

Japanese Office Action dated Jan. 11, 2011 in JP Appln. No. 2008-086109 (in Japanese).

* cited by examiner

REFRIGERATING APPARATUS

BACKGROUND OF THE INVENTION

1. Field of the Invention

The present invention relates to a refrigerating apparatus which includes a refrigerant circuit constituted by connecting a compressor, a gas cooler, a pressure reducing unit, an evaporator and the like via pipes and in which a natural refrigerant such as carbon dioxide ($CO_2$) is used with a supercritical pressure as the discharge-side pressure of the compressor.

2. Description of the Related Art

Heretofore, a chlorofluorocarbon-based refrigerant has been used in a refrigerating apparatus, but chlorofluorocarbon has a problem such as ozone layer destruction or global warming. Therefore, the use of chlorofluorocarbon has started to be strictly regulated, and the development of a refrigerating apparatus has been advanced in which a natural refrigerant such as $CO_2$ or hydrocarbon is used as a substitute refrigerant.

In particular, $CO_2$ is the natural refrigerant having a small global warming coefficient, and is incombustible and non-toxic unlike hydrocarbon having inflammability or ammonia having toxicity. Therefore, $CO_2$ is expected as the next refrigerant that is eco-friendly and highly safe.

However, $CO_2$ has a critical point of 31.1° C., 7.38 MPa, and hence a very high pressure is required for performing heat exchange accompanied by phase change such as evaporation or condensation in the refrigerating apparatus. Therefore, $CO_2$ compressed in the refrigerating apparatus is brought into a high-temperature high-pressure supercritical state and discharged from a compressor.

It is known that a method of performing inner heat exchange by use of a cascade heat exchanger (an inner heat exchanger) as shown in FIG. 1 is effective in a case where the refrigerant having the above-mentioned characteristics is used in the refrigerating apparatus (see Japanese Patent Application Laid-Open No. 2004-270517). In FIG. 1, $CO_2$ is used as the refrigerant, reference numeral 11 is a two-stage compressor, 12 is a gas cooler, 13 is a cascade heat exchanger, 23 is an expansion valve (a pressure reducing unit) and 15 is an evaporator.

A low-pressure gas refrigerant sucked by the compressor 11 is compressed into a high-temperature high-pressure state by the two-stage compressor 11, and discharged in a supercritical state. The refrigerant discharged in the supercritical state is cooled in the gas cooler 12, and then flows into a high-pressure-side circuit 13-*a* of the cascade heat exchanger 13.

The refrigerant passed through the high-pressure-side circuit 13-*a* of the cascade heat exchanger 13 has the pressure reduced by the expansion valve 23, and the refrigerant in the evaporator 15 cools the evaporator 15 and the periphery of the evaporator. The refrigerant passed through the evaporator 15 has a low temperature and low pressure to flow into the low-pressure-side circuit 13-*b* of the cascade heat exchanger 13.

Here, the high-pressure-side circuit 13-*a* of the cascade heat exchanger 13 usually has a temperature higher than that of the low-pressure-side circuit 13-*b*, so that the heat exchange between both the circuits is performed. Therefore, the refrigerant cooled by the gas cooler 12 passes through the high-pressure-side circuit 13-*a*, and is further cooled, whereby a refrigerating ability in the evaporator 15 improves.

Then, the refrigerant passed through the low-pressure-side circuit 13-*b* of the cascade heat exchanger 13 is again sucked by the two-stage compressor 11, thereby forming a refrigerant circuit.

However, the refrigerant discharged from the two-stage compressor 11 has very high temperature and pressure. Therefore, when the gas cooler 12, the evaporator 15 and the like have a high temperature, the refrigerant passes through the gas cooler 12 and the high-pressure-side circuit 13-*a* of the cascade heat exchanger 13. Even after the cooling is performed, the refrigerant sometimes has a gas state.

The amount of heat absorbed in the evaporator 15 by the refrigerant having the gas state and having the pressure reduced by the expansion valve 23 is smaller than that of heat absorbed in the evaporator 15 by a liquid refrigerant having the pressure reduced by the expansion valve 23. Therefore, to effectively perform cooling in the evaporator 15, the low-temperature liquid refrigerant is preferable.

In a case where the refrigerant having the supercritical state when discharged from the compressor is used as a refrigerant, the amount of the refrigerant with which the refrigerating apparatus is to be filled has to be increased to rapidly perform the cooling. However, there occurs a problem that a large amount of liquefied excessive refrigerant is generated in the refrigerating apparatus in a case where the refrigerating apparatus is sufficiently cooled.

SUMMARY OF THE INVENTION

A refrigerating apparatus according to a first aspect of the invention is characterized by a refrigerating apparatus in which a compressor, a gas cooler, a first pressure reducing unit and an evaporator are connected to one another via pipes and in which a natural refrigerant is used as a refrigerant, the apparatus comprising: a second pressure reducing unit and a liquid receiver between the gas cooler and the first pressure reducing unit, wherein the liquid receiver is connected to the suction port of the compressor via a pipe.

A refrigerating apparatus according to a second aspect of the invention is characterized by a refrigerating apparatus in which a compressor, a gas cooler, a first pressure reducing unit and an evaporator are connected to one another via pipes and in which a natural refrigerant is used as a refrigerant, the apparatus comprising: a second pressure reducing unit and a liquid receiver between the gas cooler and the first pressure reducing unit, wherein the liquid receiver is connected to the intermediate pressure portion of the compressor via a pipe.

A refrigerating apparatus according to a third aspect of the invention is characterized in that the refrigerating apparatus according to the first or second aspect of the invention further comprises: an inner heat exchanger between the gas cooler and the second pressure reducing unit, wherein the outlet of the evaporator is directly connected to the suction port of the compressor via a pipe in parallel with a separate pipe which connects the outlet of the evaporator to the suction port of the compressor via an opening/closing valve and the inner heat exchanger.

A refrigerating apparatus according to a fourth aspect of the invention is characterized in that in the refrigerating apparatus according to any one of the first to third aspects of the invention, an intermediate portion between the heat exchanger and the second pressure reducing unit is connected to an intermediate portion between the liquid receiver and the first pressure reducing unit via the opening/closing valve and a pipe.

A refrigerating apparatus according to a fifth aspect of the invention is characterized in that in the refrigerating apparatus according to any one of the first to fourth aspects of the invention, the opening/closing degree of the second pressure reducing unit is controlled in accordance with the suction-side pressure of the compressor.

A refrigerating apparatus according to a sixth aspect of the invention is characterized in that in the refrigerating apparatus according to any one of the first to fourth aspects of the invention, the opening/closing degree of the second pressure reducing unit is controlled in accordance with a pressure difference between the discharge-side pressure of the compressor and the suction-side pressure thereof.

According to the first aspect of the invention, the refrigerating apparatus in which the compressor, the gas cooler, the first pressure reducing unit and the evaporator are connected to one another via the pipes and in which the natural refrigerant is used as the refrigerant comprises the second pressure reducing unit and the liquid receiver between the gas cooler and the first pressure reducing unit. The liquid receiver is connected to the suction port of the compressor via the pipe. In consequence, the pressure of the refrigerant cooled in the gas cooler is reduced by the second pressure reducing unit to expand the refrigerant, whereby the refrigerant is further cooled, and the liquefied refrigerant can be received in the liquid receiver. Therefore, the liquid refrigerant can be supplied to the evaporator. Furthermore, the gas refrigerant in the liquid receiver can efficiently be sucked from the suction port of the compressor, so that a pressure reducing effect produced by the second pressure reducing unit can be improved. Therefore, in the refrigerating apparatus in which the liquid refrigerant is efficiently received in the liquid receiver and in which the natural refrigerant is used, a high refrigerating ability can be obtained.

In the second aspect of the invention, the refrigerating apparatus in which the compressor, the gas cooler, the first pressure reducing unit and the evaporator are connected to one another via the pipes and in which the natural refrigerant is used as the refrigerant comprises the second pressure reducing unit and the liquid receiver between the gas cooler and the first pressure reducing unit, wherein the liquid receiver is connected to the intermediate pressure portion of the compressor via the pipe. In consequence, the pressure of the refrigerant cooled in the gas cooler is reduced by the second pressure reducing unit to expand the refrigerant, whereby the refrigerant is further cooled, and the liquefied refrigerant can be received in the liquid receiver. Therefore, the liquid refrigerant can be supplied to the evaporator. Furthermore, the gas refrigerant in the liquid receiver can be sucked by the intermediate pressure portion of the compressor, so that the pressure reducing effect produced by the second pressure reducing unit can be improved. Therefore, in the refrigerating apparatus in which the liquid refrigerant is efficiently received in the liquid receiver and in which the natural refrigerant is used, the high refrigerating ability can be obtained.

Moreover, in the third aspect of the invention, the refrigerating apparatus further comprises: the inner heat exchanger between the gas cooler and the second pressure reducing unit, and the outlet of the evaporator is directly connected to the suction port of the compressor via the pipe in parallel with the separate pipe which connects the outlet of the evaporator to the suction port of the compressor via the opening/closing valve and the inner heat exchanger. In consequence, when the refrigerating apparatus has a sufficient refrigerating ability, the refrigerant discharged from the gas cooler can be supercooled by the low-temperature low-pressure refrigerant discharged from the evaporator. Furthermore, the refrigerating ability in the evaporator is sufficiently secured, whereby a temperature difference between the high-temperature refrigerant and the low-temperature refrigerant can be increased in the inner heat exchanger. Therefore, a heat exchange efficiency can be improved.

Furthermore, in the fourth aspect of the invention, the intermediate portion between the heat exchanger and the second pressure reducing unit is connected to the intermediate portion between the liquid receiver and the first pressure reducing unit via the opening/closing valve and the pipe, whereby the refrigerant can be supplied to the first pressure reducing unit without circulating the refrigerant through the second pressure reducing unit and the liquid receiver. In consequence, when the refrigerant is sufficiently condensed in the gas cooler and the inner heat exchanger, the refrigerant is not expanded in the second pressure reducing unit and the liquid receiver, and the condensed refrigerant is directly fed into the evaporator, whereby the refrigerating efficiency of the refrigerating apparatus can be improved.

In addition, according to the fifth aspect of the invention, the opening/closing degree of the second pressure reducing unit is controlled in accordance with the suction-side pressure of the compressor, whereby the amount of the refrigerant to be received in the liquid receiver and the flow rate into the compressor can be controlled. Therefore, when the refrigerant gathers on the high pressure side of the compressor, the rise of the pressure can be prevented.

Moreover, in the sixth aspect of the invention, the opening/closing degree of the second pressure reducing unit is controlled in accordance with the pressure difference between the discharge-side pressure of the compressor and the suction-side pressure thereof, whereby the amount of the refrigerant to be received in the liquid receiver and the flow rate into the compressor can be controlled. Therefore, when the refrigerant gathers on the high pressure side of the compressor, the rise of the pressure can be prevented. It is to be noted that the second pressure reducing unit is controlled so as to obtain a constant difference between the pressures before and after the compressor. Therefore, a substantially constant difference between the pressures before and after the first expansion valve is obtained, and the operation of the first pressure reducing unit can be stabilized. In consequence, the refrigerating ability of the refrigerating apparatus can be stabilized.

DETAILED DESCRIPTION OF THE PREFERRED EMBODIMENTS

Next, embodiments of the present invention will be described in detail with reference to the drawings.

Embodiment 1

(1) Refrigerating Apparatus to which the Present Invention is Applied

Figure 1:
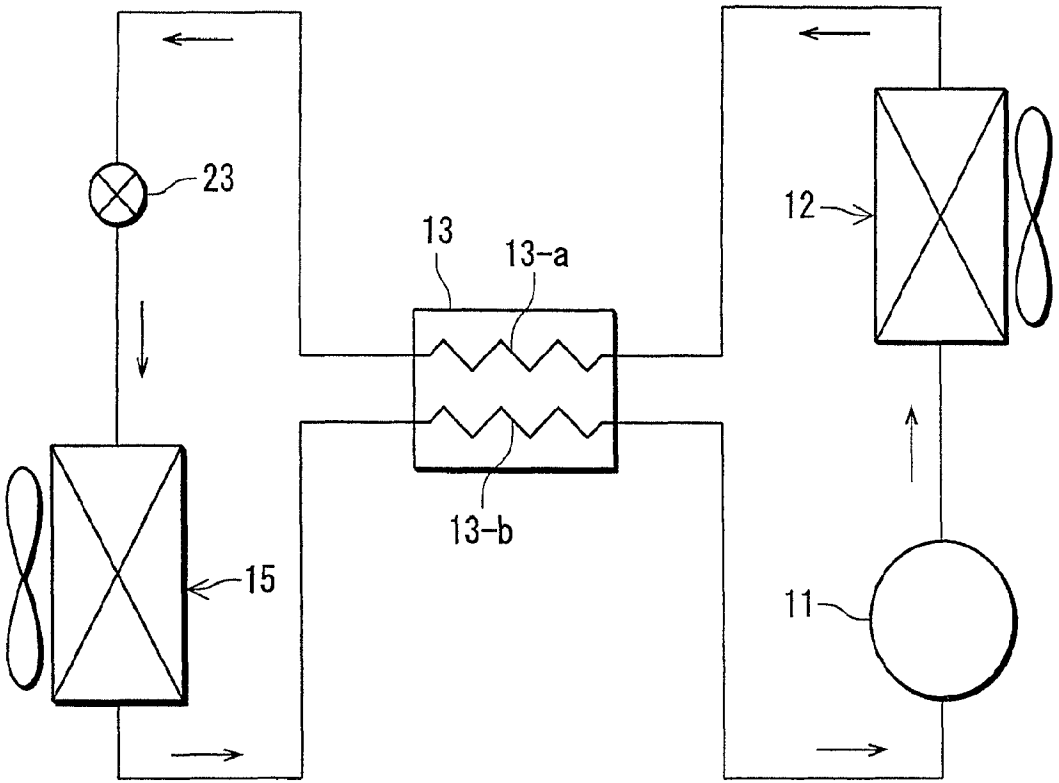
FIG. 1 Prior Art
FIG. 1 shows a refrigerant circuit in a conventional trans-critical refrigerating apparatus.
Figure 2:
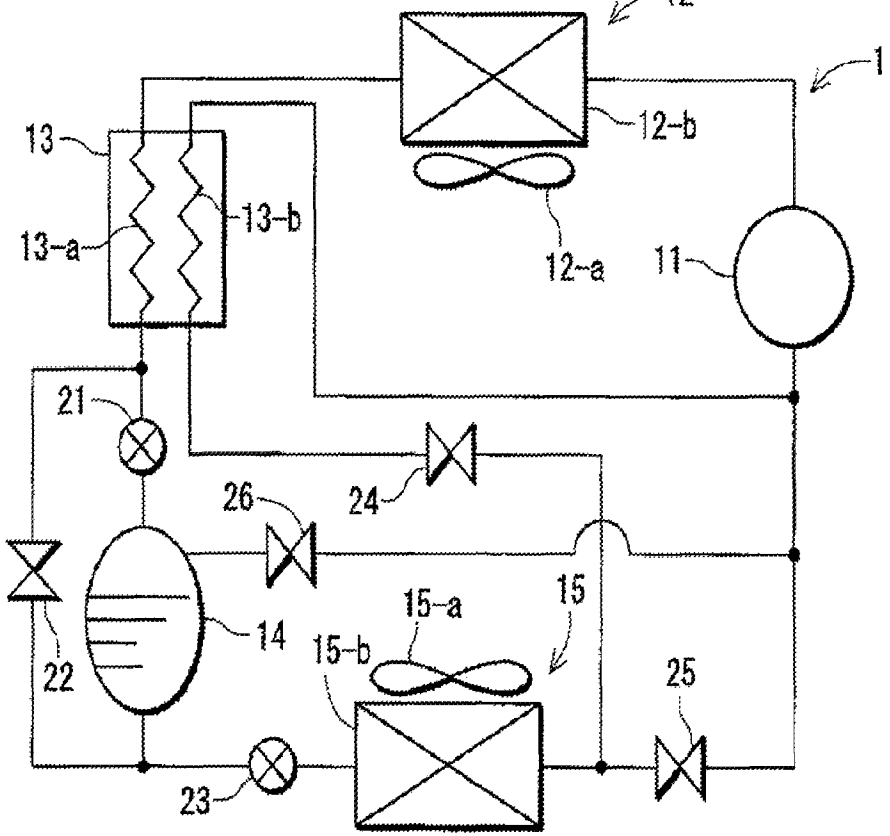
FIG. 2 shows a refrigerant circuit according to one embodiment in a trans-critical refrigerating apparatus of the present invention.

FIG. 2 shows a refrigerant circuit 1 of a refrigerating apparatus according to one embodiment to which the present invention is applied. In the drawing, reference numeral 11 is a compressor, 12 is a gas cooler, 13 is a cascade heat exchanger (an inner heat exchanger), 14 is a liquid receiver, 15 is an evaporator, 21 is a second expansion valve (a pressure reducing unit), 22, 24, 25 and 26 are electromagnetic valves (opening/closing valves), and 23 is a first expansion valve.

It is to be noted that the compressor 11 is a multistage compressor of a single stage or two or more stages. A refrigerant has a sub-critical state on the low pressure side of this compressor 11, and the discharged refrigerant has a supercritical state, so that the whole refrigerating apparatus has a trans-critical state. As one example of the refrigerant having such properties, carbon dioxide is used in the present embodiment.

The supercritical refrigerant discharged from the compressor 11 flows into the gas cooler 12, and is air-cooled by a blower fan 12-*a*.

The refrigerant discharged from the gas cooler 12 passes through a high-pressure-side circuit 13-*a* of the cascade heat exchanger 13, and reaches the expansion valve 21 in a case where the electromagnetic valve 22 closes. The pressure of the refrigerant is reduced by the expansion valve 21 to expand and cool the refrigerant. The cooled and thus liquefied refrigerant is received in the liquid receiver 14. When the electromagnetic valve 26 opens, the vaporized refrigerant is sucked into the suction port of the compressor 11 via a bypass circuit.

The liquid refrigerant received in the liquid receiver 14 has the pressure reduced by the expansion valve 23, flows into the evaporator 15, and expands. In the present refrigerating apparatus, owing to two-stage expansion including the expansion performed by the expansion valve 21 and the expansion by the expansion valve 23, a refrigerating ability is improved.

On the other hand, when the electromagnetic valve 22 opens, the refrigerant discharged from the high-pressure-side circuit 13-*a* of the cascade heat exchanger 13 reaches the expansion valve 23 via the electromagnetic valve 22, and the refrigerant has the pressure reduced by the expansion valve 23 to flow into the evaporator 15.

The refrigerant which has flowed into the evaporator 15 evaporates to absorb heat, and outside air circulated by a blower fan 15-*a* is cooled. When the electromagnetic valve 24 closes and the electromagnetic valve 25 opens, the low-temperature low-pressure refrigerant discharged from the evaporator 15 is sucked from the low pressure side of the compressor 11.

On the other hand, when the electromagnetic valve 24 opens and the electromagnetic valve 25 closes, the low-temperature low-pressure refrigerant discharged from the evaporator 15 is sucked from the low pressure side of the compressor 11 via a low-pressure-side circuit 13-*b* of the cascade heat exchanger 13.

Figure 3:
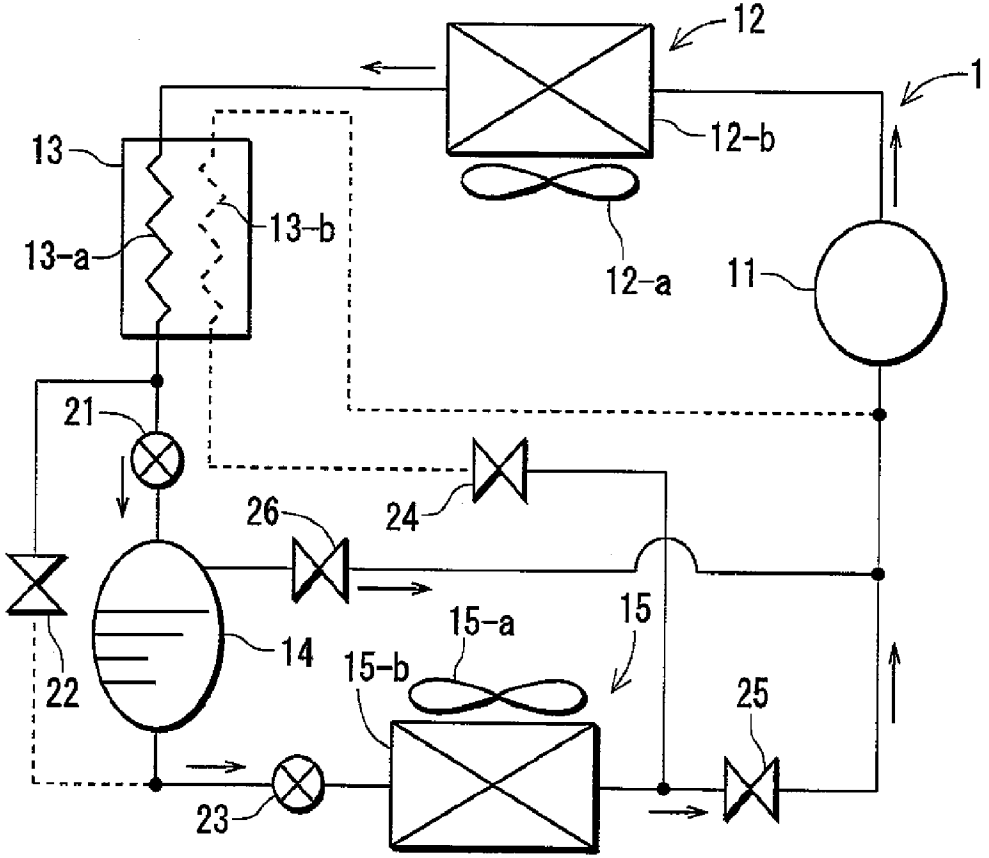
FIG. 3 shows the refrigerant circuit according to the embodiment of the present invention in a case where a refrigerating ability runs short.

(2) In a Case where the Refrigerating Ability of the Refrigerating Apparatus Runs Short In a case where the refrigerating ability of the refrigerating apparatus runs short, the refrigerant circuit 1 has a constitution shown in FIG. 3 in which the electromagnetic valves 22 and 24 close and the electromagnetic valves 25 and 26 open. The refrigerant discharged from the compressor 11 and cooled by the gas cooler 12 reaches the expansion valve 21 via the high-pressure-side circuit 13-*a* of the cascade heat exchanger 13.

When the refrigerating ability runs short, the refrigerant discharged from the compressor 11 has a very high temperature. Therefore, when the refrigerant is not sufficiently cooled by the gas cooler 12, the refrigerant discharged from the gas cooler 12 is supposed to have a supercritical or trans-critical state.

It is difficult to perform the sufficient cooling with the supercritical refrigerant in the evaporator 15. Therefore, this refrigerant has the pressure reduced by the expansion valve 21, and is thus cooled, and a mixed state of a liquid and a gas is brought in the liquid receiver. In consequence, the liquid refrigerant is received in the lower part of the liquid receiver 14, and the gas refrigerant is received in the upper part of the liquid receiver.

However, when the liquid receiver 14 is filled with the gas refrigerant and the inner pressure of the liquid receiver 14 rises, the evaporation of the refrigerant is limited, so that the cooling effect due to the pressure reduction of the expansion valve 21 lowers.

In the present invention, the upper part of the liquid receiver 14 is connected to the suction port of the compressor 11 via the electromagnetic valve 26, whereby the gas refrigerant with which the liquid receiver 14 has been filled is sucked by the compressor 11, and the inner pressure of the liquid receiver 14 is reduced. Therefore, the refrigerant can sufficiently be expanded in the liquid receiver 14, so that the refrigerant can efficiently be cooled and liquefied.

Moreover, the refrigerant directly flows into the low pressure portion of the compressor 11 from the evaporator 15, and is directly sucked by the compressor 11 from the liquid receiver 14, so that the amount of the refrigerant to be circulated increases and the refrigerating ability further improves.

Figure 4:
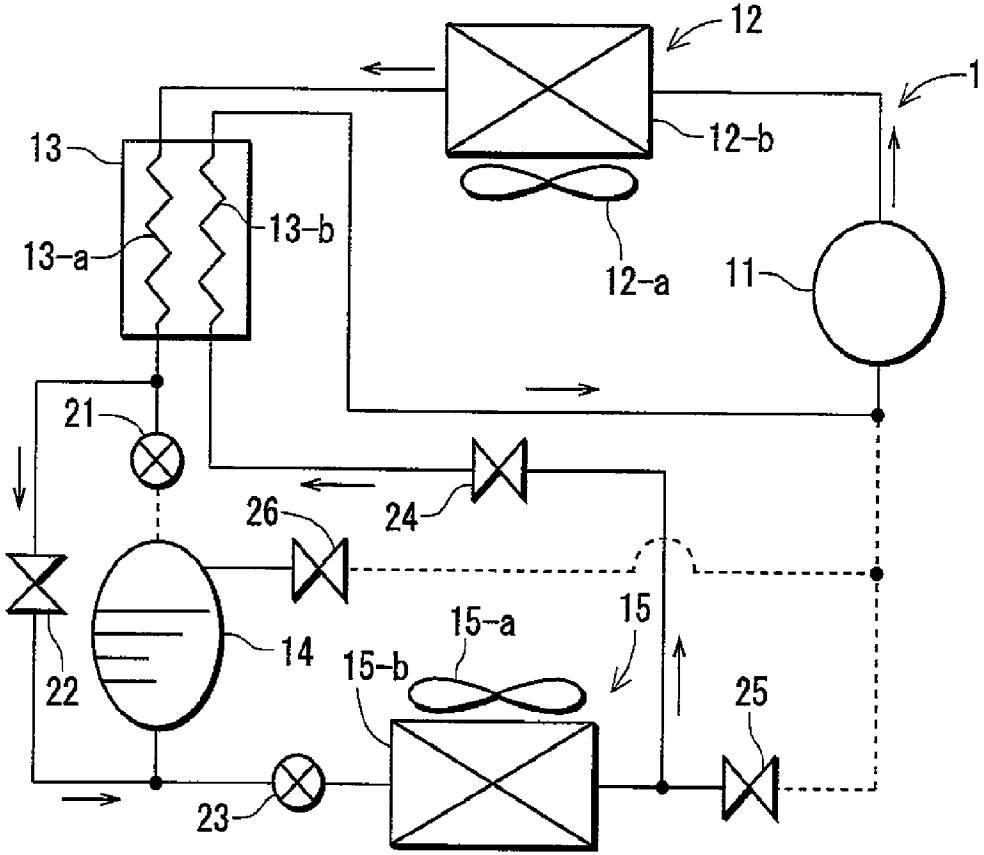
FIG. 4 shows the refrigerant circuit according to the embodiment of the present invention in a case where the refrigerating ability is sufficient.

(3) In a Case where the Refrigerating Ability of the Refrigerating Apparatus is Sufficient In a case where the refrigerating ability of the refrigerating apparatus is sufficient, the refrigerant circuit 1 has a constitution shown in FIG. 4 in which the electromagnetic valves 22 and 24 open, and the expansion valve 21 and the electromagnetic valves 25 and 26 close. The refrigerant discharged from the compressor 11 and cooled by the gas cooler 12 reaches the expansion valve 23 via the high-pressure-side circuit 13-*a* of the cascade heat exchanger 13.

When the refrigerating ability is sufficient, the refrigerant cooled and liquefied in the gas cooler 12 flows into the high-pressure-side circuit 13-*a* of the cascade heat exchanger 13. Moreover, the refrigerant discharged from the evaporator 15 in a state in which the refrigerating ability is sufficient has a low temperature and low pressure, so that the refrigerant of the high-pressure-side circuit 13-*a* is supercooled by the refrigerant of the low-pressure-side circuit 13-*b* in the cascade heat exchanger 13.

The supercooled refrigerant has the pressure reduced by the expansion valve 23 via the electromagnetic valve 22, and flows into the evaporator 15. In the evaporator 15, the liquid refrigerant absorbs heat while evaporating, whereby the outside air circulated by the blower fan 15-*a* is cooled.

The gas refrigerant brought to the low temperature and low pressure flows into the low-pressure-side circuit 13-*b* of the cascade heat exchanger 13 via the electromagnetic valve 24 to cool the refrigerant flowing through the high-pressure-side circuit 13-*a*. The refrigerant discharged from the low-pressure-side circuit 13-*b* is sucked on the low pressure side of the compressor 11, thereby constituting the refrigerating apparatus.

Figure 5:
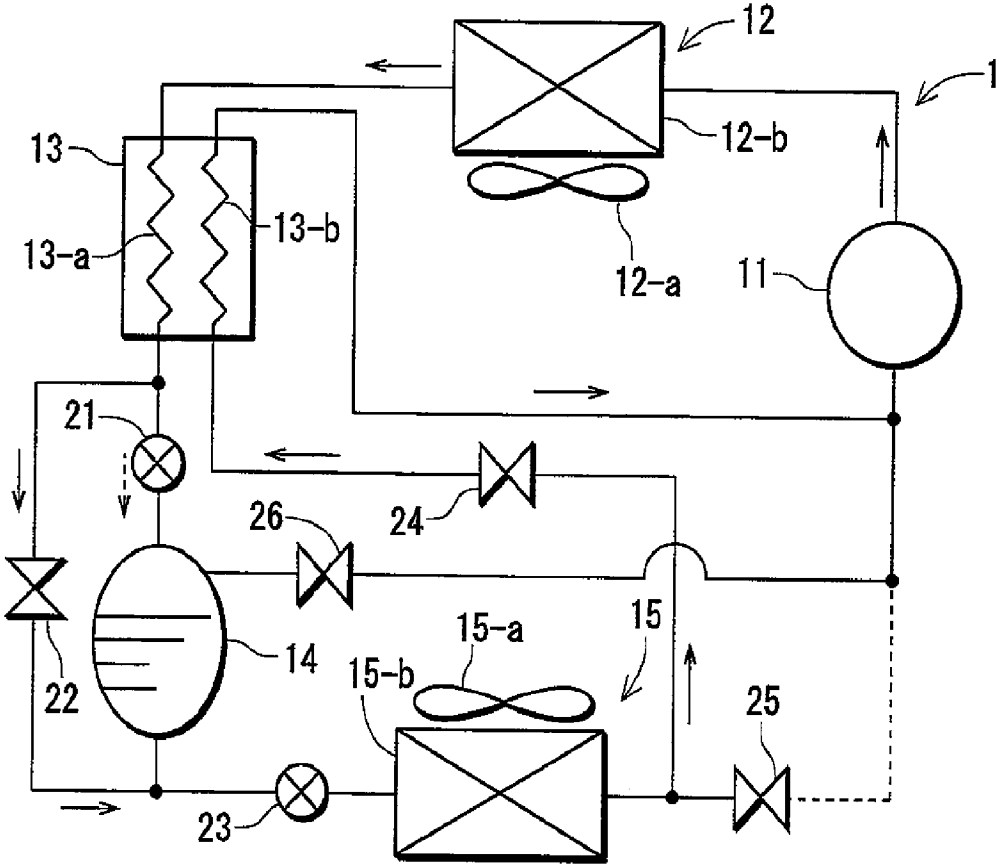
FIG. 5 shows the refrigerant circuit according to the embodiment of the present invention in a case where the refrigerating ability is excessive.

(4) In a Case where the Refrigerating Ability of the Refrigerating Apparatus is Excessive In a case where the refrigerating ability of the refrigerating apparatus becomes sufficient and the refrigerant becomes excessive on the high pressure side of the compressor, the refrigerant circuit 1 has a constitution shown in FIG. 5 in which the electromagnetic valves 22, 24 and 26 open, and the electromagnetic valve 25 closes. The refrigerant discharged from the compressor 11 and cooled by the gas cooler 12 reaches the expansion valve 23 via the high-pressure-side circuit 13-*a* of the cascade heat exchanger 13.

When the refrigerating ability becomes sufficient, the expansion valve 23 is substantially closed, so that the low-pressure-side pressure of the compressor 11 decreases. When this state continues for a long time, the refrigerant gathers on the high pressure side of the compressor 11, and hence the high-pressure-side pressure of the compressor 11 rises.

Carbon dioxide for use as the refrigerant in the present embodiment has a very high pressure in a trans-critical state. Therefore, when the pressure rises on the high pressure side of the compressor 11, the safety of the refrigerating apparatus is impaired, and weight increase is caused owing to the rise of the durable pressure of the elements constituting the refrigerating apparatus.

Moreover, when a difference between the high-pressure-side pressure of the compressor 11 and the low-pressure-side pressure thereof increases, a difference between the pressures before and after the expansion valve 23 also increases, so that the malfunction of the expansion valve 23 might occur. In consequence, the operation of the whole refrigerating apparatus becomes unstable.

Here, the expansion valve 21 is opened to receive the liquid refrigerant liquefied in the liquid receiver 14, and the gas/liquid bypasses the compressor 11. In consequence, the refrigerant which gathers on the high pressure side of the compressor 11 is received in the liquid receiver 14 and discharged to the compressor 11, whereby the high-pressure-side pressure of the compressor 11 can be lowered.

At this time, the valve opening degree of the expansion valve 21 is controlled so that the high-pressure-side HP pressure of the compressor 11 becomes a predetermined value or less, whereby the safety of the refrigerating apparatus can be improved.

Figure 6:
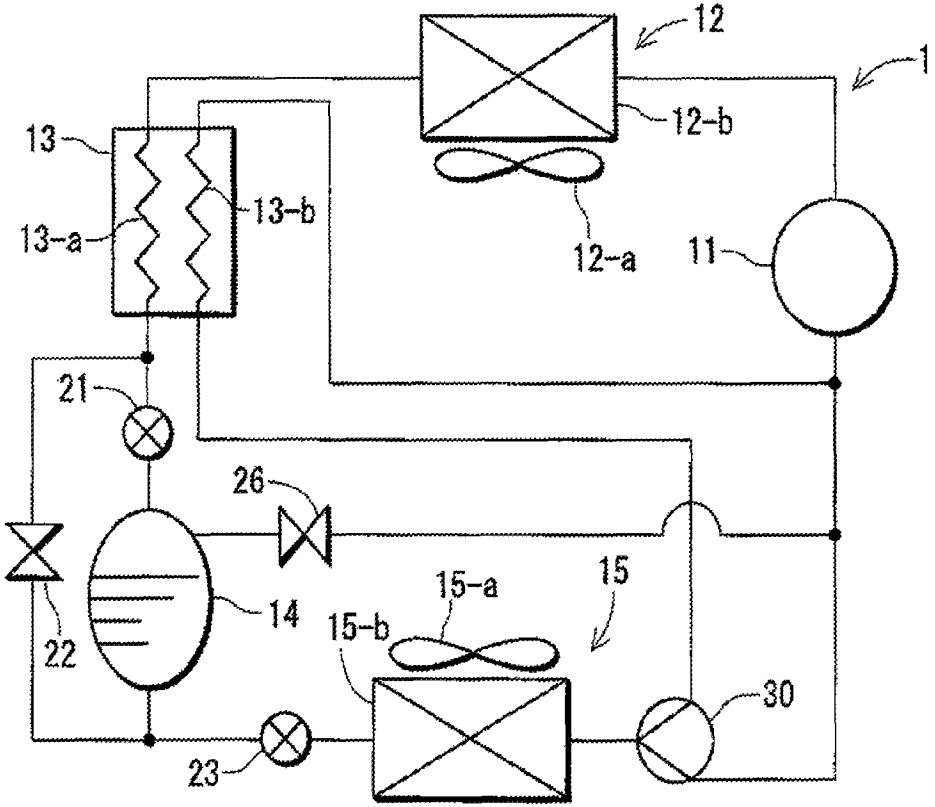
FIG. 6 shows the refrigerant circuit according to the embodiment in the trans-critical refrigerating apparatus of the present invention in which a three-way valve is used.
Figure 7:
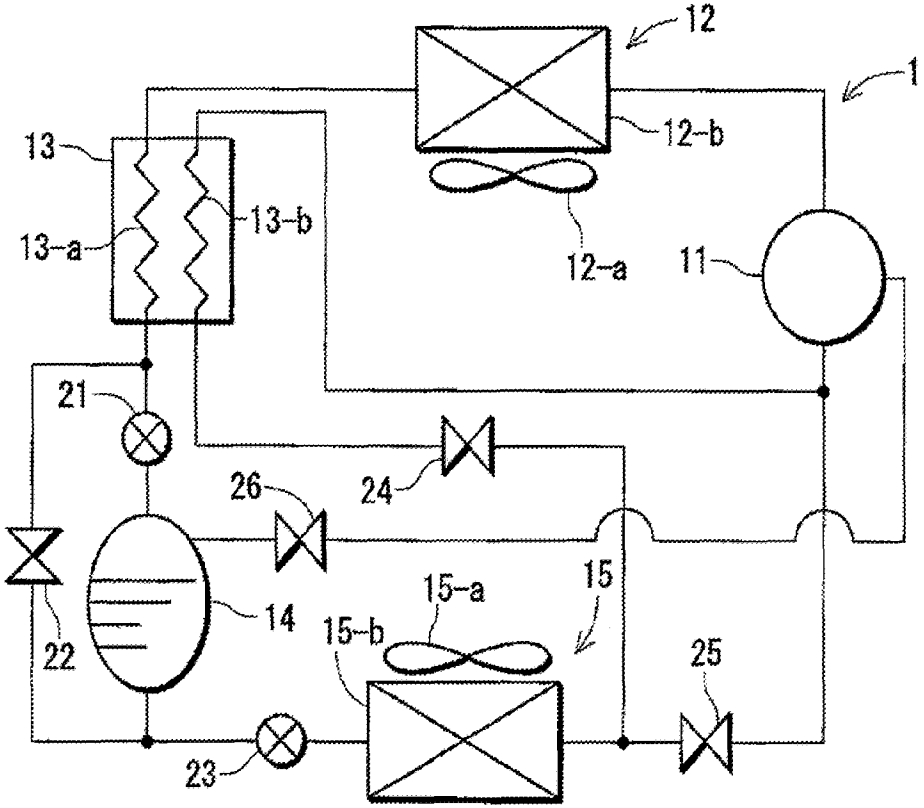
FIG. 7 shows a refrigerant circuit according to another embodiment in the trans-critical refrigerating apparatus of the present invention.

It is to be noted that the valve opening degree of the expansion valve 21 is controlled based on the high-pressure-side pressure and low-pressure-side pressure of the compressor 11, but may be controlled based on a high-pressure-side temperature and a low-pressure-side temperature to stabilize the refrigerating apparatus. FIGS. 2, 6 and 7 illustrate means C for controlling the expansion valve 21, based on the condition of the high-pressure side HP or low-pressure side LP of compressor 11.

Moreover, in the present embodiment, the refrigerant circuit is controlled with the electromagnetic valves, but this is not restrictive. For example, the refrigerant circuit may be constituted using a three-way valve 30 as shown in FIG. 6.

Embodiment 2

Next, another embodiment of the present invention will be described in detail with reference to FIGS. 7 to 11.

(5) Refrigerating Apparatus to which the Present Invention is Applied

FIG. 7 shows a refrigerant circuit 1 of a refrigerating apparatus according to another embodiment to which the present invention is applied. In the drawing, reference numeral 11 is a compressor, 12 is a gas cooler, 13 is a cascade heat exchanger (an inner heat exchanger), 14 is a liquid receiver, 15 is an evaporator, 21 is a second expansion valve (a pressure reducing unit), 22, 24, and 26 are electromagnetic valves (opening/closing valves), and 23 is a first expansion valve.

It is to be noted that the compressor 11 is a multistage compressor of two or more stages in which a refrigerant can be sucked not only from a low pressure portion but also from an intermediate pressure portion. The refrigerant has a subcritical state on the low pressure side of this compressor 11, and the discharged refrigerant has a supercritical state, so that the whole refrigerating apparatus has a trans-critical state. As one example of the refrigerant having such properties, carbon dioxide is used in the present embodiment.

The supercritical refrigerant discharged from the compressor 11 flows into the gas cooler 12, and is air-cooled by a blower fan 12-*a*.

The refrigerant discharged from the gas cooler 12 passes through a high-pressure-side circuit 13-*a* of the cascade heat exchanger 13, and reaches the expansion valve 21 in a case where the electromagnetic valve 22 closes. The pressure of the refrigerant is reduced by the expansion valve 21 to expand and cool the refrigerant. The cooled and thus liquefied refrigerant is received in the liquid receiver 14. When the electromagnetic valve 26 opens, the vaporized refrigerant is sucked into the intermediate pressure portion of the compressor 11 via a bypass circuit.

The liquid refrigerant received in the liquid receiver 14 has the pressure reduced by the expansion valve 23, flows into the evaporator 15, and expands. In the present refrigerating apparatus, owing to two-stage expansion including the expansion performed by the expansion valve 21 and the expansion by the expansion valve 23, a refrigerating ability is improved.

On the other hand, when the electromagnetic valve 22 opens, the refrigerant discharged from the high-pressure-side circuit 13-*a* of the cascade heat exchanger 13 reaches the expansion valve 23 via the electromagnetic valve 22, and the refrigerant has the pressure reduced by the expansion valve 23 to flow into the evaporator 15.

The refrigerant which has flowed into the evaporator 15 evaporates to absorb heat, and outside air circulated by a blower fan 15-*a* is cooled. When the electromagnetic valve 24 closes and the electromagnetic valve 25 opens, the low-temperature low-pressure refrigerant discharged from the evaporator 15 is sucked from the low pressure side of the compressor 11.

On the other hand, when the electromagnetic valve 24 opens and the electromagnetic valve 25 closes, the low-temperature low-pressure refrigerant discharged from the evaporator 15 is sucked from the low pressure side of the compressor 11 via a low-pressure-side circuit 13-*b* of the cascade heat exchanger 13.

Figure 8:
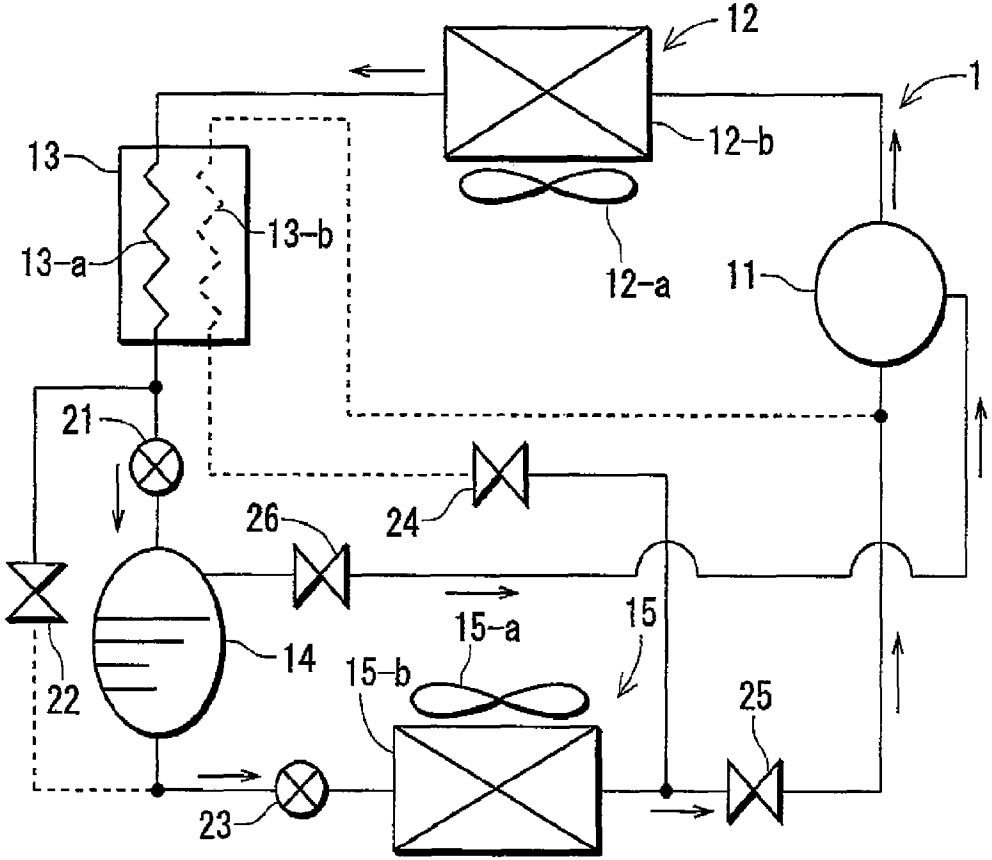
FIG. 8 shows the refrigerant circuit according to the embodiment of the present invention in a case where a refrigerating ability runs short.

(6) In a Case where the Refrigerating Ability of the Refrigerating Apparatus runs Short In a case where the refrigerating ability of the refrigerating apparatus runs short, the refrigerant circuit 1 has a constitution shown in FIG. 8 in which the electromagnetic valves 22 and 24 close and the electromagnetic valves 25 and 26 open. The refrigerant discharged from the compressor 11 and cooled by the gas cooler 12 reaches the expansion valve 21 via the high-pressure-side circuit 13-*a* of the cascade heat exchanger 13.

When the refrigerating ability runs short, the refrigerant discharged from the compressor 11 has a very high temperature. Therefore, when the refrigerant is not sufficiently cooled by the gas cooler 12, the refrigerant discharged from the gas cooler 12 is supposed to have a supercritical or trans-critical state.

It is difficult to perform the sufficient cooling with the supercritical refrigerant in the evaporator 15. Therefore, this refrigerant has the pressure reduced by the expansion valve 21, and is thus cooled, and a mixed state of a liquid and a gas is brought in the liquid receiver. In consequence, the liquid refrigerant is received in the lower part of the liquid receiver 14, and the gas refrigerant is received in the upper part of the liquid receiver.

However, when the liquid receiver 14 is filled with the gas refrigerant and the inner pressure of the liquid receiver 14 rises, the evaporation of the refrigerant is limited, so that the cooling effect due to the pressure reduction of the expansion valve 21 lowers.

In the present invention, the upper part of the liquid receiver 14 is connected to the intermediate pressure portion of the compressor 11 via the electromagnetic valve 26, whereby the gas refrigerant with which the liquid receiver 14 has been filled is sucked by the intermediate pressure portion of the compressor 11, and the inner pressure of the liquid receiver 14 is reduced. Therefore, the refrigerant can sufficiently be expanded in the liquid receiver 14, so that the refrigerant can efficiently be cooled and liquefied.

Moreover, the refrigerant directly flows into the low pressure portion of the compressor 11 from the evaporator 15, and is directly sucked by the intermediate pressure portion of the compressor 11 from the liquid receiver 14, so that the amount of the refrigerant to be circulated increases and the refrigerating ability further improves.

Figure 9:
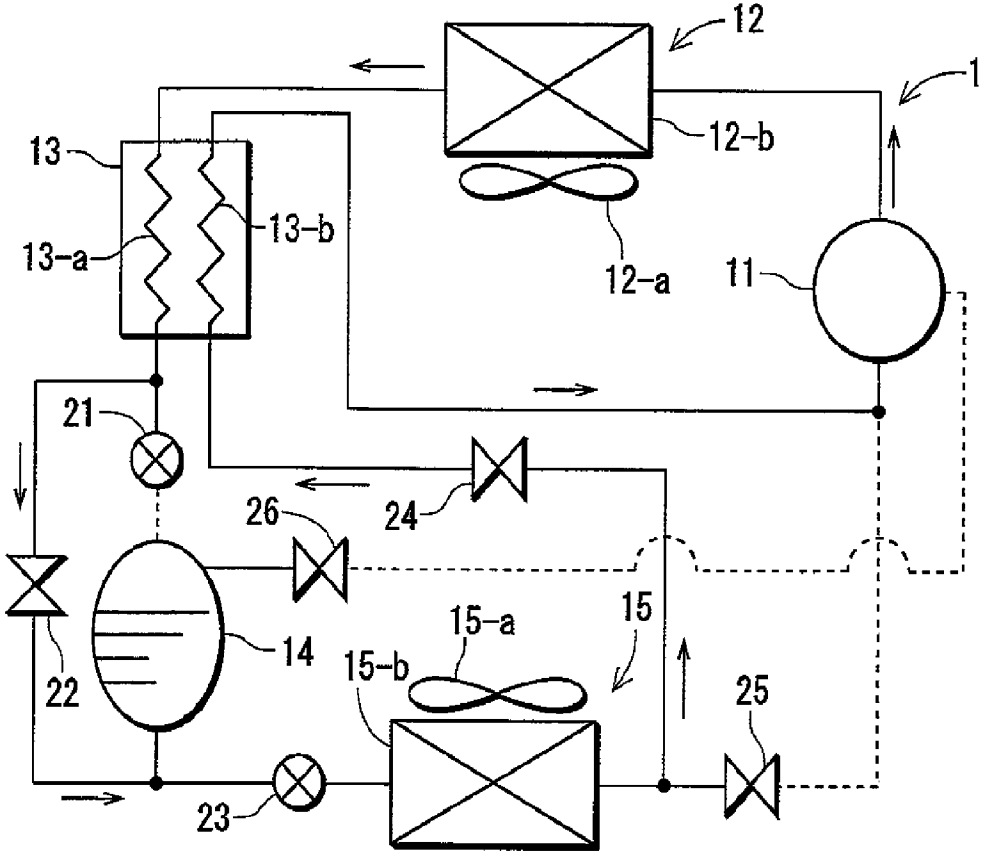
FIG. 9 shows the refrigerant circuit according to the embodiment of the present invention in a case where the refrigerating ability is sufficient.

(7) In a Case where the Refrigerating Ability of the Refrigerating Apparatus is Sufficient In a case where the refrigerating ability of the refrigerating apparatus is sufficient, the refrigerant circuit 1 has a constitution shown in FIG. 9 in which the electromagnetic valves 22 and 24 open, and the expansion valve 21 and the electromagnetic valves 25 and 26 close. The refrigerant discharged from the compressor 11 and cooled by the gas cooler 12 reaches the expansion valve 23 via the high-pressure-side circuit 13-*a* of the cascade heat exchanger 13.

When the refrigerating ability is sufficient, the refrigerant cooled and liquefied in the gas cooler 12 flows into the high-pressure-side circuit 13-*a* of the cascade heat exchanger 13. Moreover, the refrigerant discharged from the evaporator 15 in a state in which the refrigerating ability is sufficient has a low temperature and low pressure, so that the refrigerant of the high-pressure-side circuit 13-*a* is supercooled by the refrigerant of the low-pressure-side circuit 13-*b* in the cascade heat exchanger 13.

The supercooled refrigerant has the pressure reduced by the expansion valve 23 via the electromagnetic valve 22, and flows into the evaporator 15. In the evaporator 15, the liquid refrigerant absorbs heat while evaporating, whereby the outside air circulated by the blower fan 15-*a* is cooled.

The gas refrigerant brought to the low temperature and low pressure flows into the low-pressure-side circuit 13-*b* of the cascade heat exchanger 13 via the electromagnetic valve 24 to cool the refrigerant flowing through the high-pressure-side circuit 13-*a*. The refrigerant discharged from the low-pressure-side circuit 13-*b* is sucked on the low pressure side of the compressor 11, thereby constituting the refrigerating apparatus.

Figure 10:
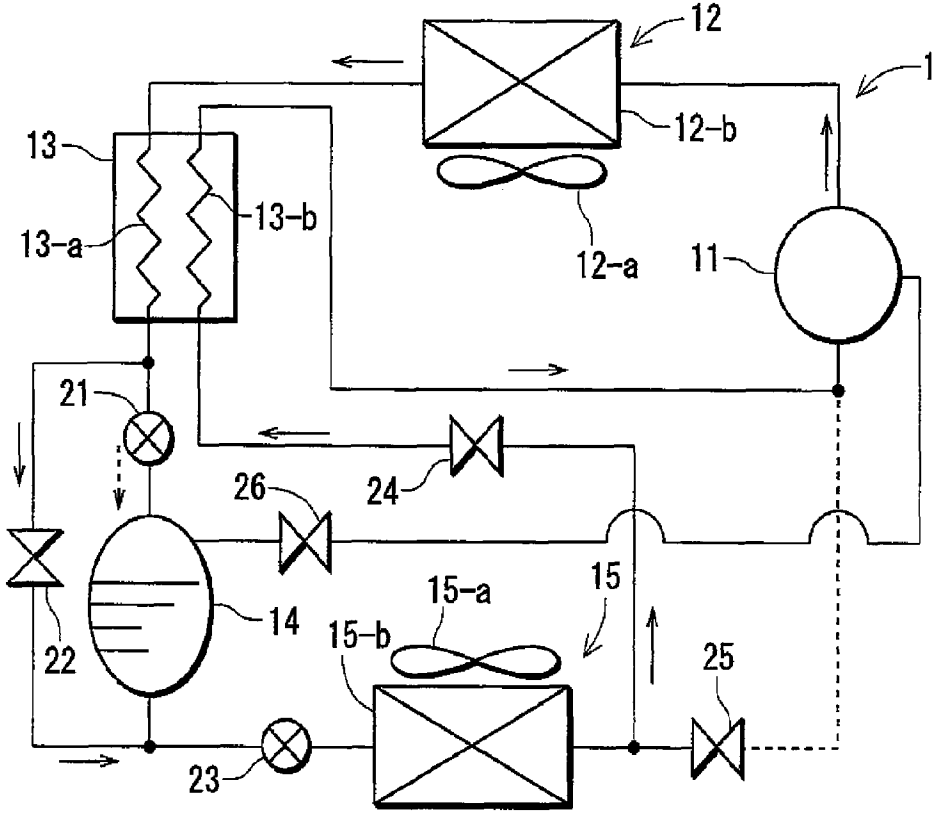
FIG. 10 shows the refrigerant circuit according to the embodiment of the present invention in a case where the refrigerating ability is excessive.

(8) In a Case where the Refrigerating Ability of the Refrigerating Apparatus is Excessive In a case where the refrigerating ability of the refrigerating apparatus becomes sufficient and the refrigerant becomes excessive on the high pressure side of the compressor, the refrigerant circuit 1 has a constitution shown in FIG. 10 in which the electromagnetic valves 22, 24 and 26 open, and the electromagnetic valve 25 closes. The refrigerant discharged from the compressor 11 and cooled by the gas cooler 12 reaches the expansion valve 23 via the high-pressure-side circuit 13-*a* of the cascade heat exchanger 13.

When the refrigerating ability becomes sufficient, the expansion valve 23 is substantially closed, so that the low-pressure-side pressure of the compressor 11 decreases. When this state continues for a long time, the refrigerant gathers on the high pressure side of the compressor 11, and hence the high-pressure-side pressure of the compressor 11 rises.

Carbon dioxide for use as the refrigerant in the present embodiment has a very high pressure in a trans-critical state. Therefore, when the pressure rises on the high pressure side of the compressor 11, the safety of the refrigerating apparatus is impaired, and weight increase is caused owing to the rise of the durable pressure of the elements constituting the refrigerating apparatus.

Moreover, when a difference between the high-pressure-side pressure of the compressor 11 and the low-pressure-side pressure thereof increases, a difference between the pressures before and after the expansion valve 23 also increases, so that the malfunction of the expansion valve 23 might occur. In consequence, the operation of the whole refrigerating apparatus becomes unstable.

Here, the expansion valve 21 is opened to receive the liquid refrigerant liquefied in the liquid receiver 14, and the gas/liquid bypasses the intermediate pressure portion of the compressor 11. In consequence, the refrigerant which gathers on the high pressure side of the compressor 11 is received in the liquid receiver 14 and discharged to the compressor 11, whereby the high-pressure-side pressure of the compressor 11 can be lowered.

At this time, the valve opening degree of the expansion valve 21 is controlled so that the high-pressure-side pressure of the compressor 11 becomes a predetermined value or less, whereby the safety of the refrigerating apparatus can be improved.

It is to be noted that the valve opening degree of the expansion valve 23 is controlled based on the high-pressure-side pressure and low-pressure-side pressure of the compressor 11, but may be controlled based on a high-pressure-side temperature and a low-pressure-side temperature to stabilize the refrigerating apparatus.

Figure 11:
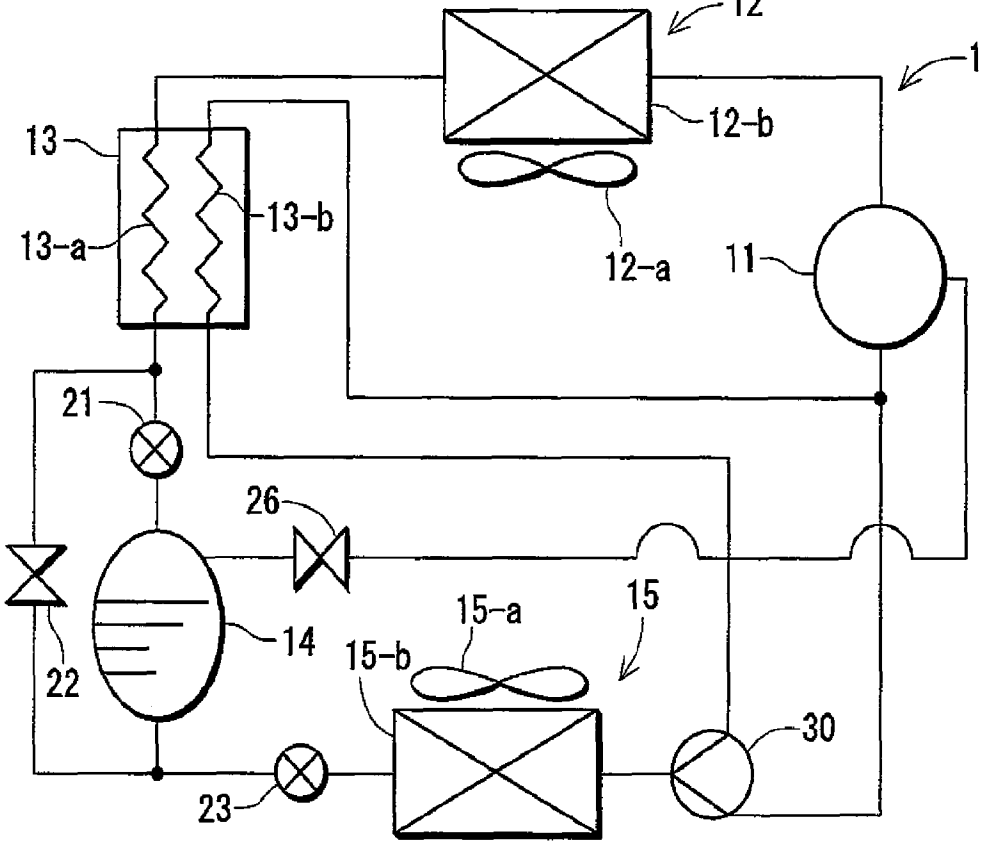
FIG. 11 shows the refrigerant circuit according to the embodiment in the trans-critical refrigerating apparatus of the present invention in which a three-way valve is used.

Moreover, in the present embodiment, the refrigerant circuit is controlled with the electromagnetic valves, but this is not restrictive. For example, the refrigerant circuit may be constituted using a three-way valve 30 as shown in FIG. 11.

What is claimed is:

1. A refrigerating apparatus in which a compressor, a gas cooler, a first pressure reducing unit and an evaporator are connected to one another via pipes and which is capable of operating with a natural refrigerant, the apparatus comprising:

a first opening/closing valve in parallel with a second pressure reducing unit and a liquid receiver, wherein the liquid receiver has an inlet at top of the liquid receiver, a first outlet at a side of the liquid receiver, and a second outlet at bottom of the liquid receiver, wherein the first opening/closing valve, the second outlet of the liquid receiver, and the second pressure reducing unit are disposed between the gas cooler and the first pressure reducing unit, wherein the first outlet of the liquid receiver is connected to a suction port of the compressor via a first pipe and a second opening/closing valve, and an inner heat exchanger having a high-pressure-side circuit and a low-pressure-side circuit, wherein the high-pressure-side circuit is disposed between the gas cooler and the second pressure reducing unit, wherein an outlet of the evaporator is directly connected to the suction port of the compressor via a second pipe and a third opening/closing valve in parallel with a third pipe which connects the outlet of the evaporator to the suction port of the compressor via a fourth opening/closing valve and the low-pressure-side circuit of the inner heat exchanger, wherein the opening/closing degree of the second pressure reducing unit is controlled in accordance with a pressure difference between the discharge-side pressure of the compressor and the suction-side pressure thereof, wherein, according to when refrigerating ability of the refrigerating apparatus is low, the natural refrigerant flows on a first path from the compressor, to the gas cooler, to the high-pressure-side circuit of the inner heat exchanger, to the second expansion valve, to the liquid receiver, to the first expansion valve, to the evaporator, and to the compressor, and a gas refrigerant flows from the liquid receiver to the compressor, wherein, according to when refrigerating ability of the refrigerating apparatus is normal, the natural refrigerant flows on a second path from the compressor, to the gas cooler, to the high-pressure-side circuit of the inner heat exchanger, to the first opening/closing valve, to the first expansion valve, to the evaporator, to the fourth opening/closing valve, to the low-pressure-side circuit of the inner heat exchanger, and to the compressor, wherein, according to when refrigerating ability of the refrigerating apparatus is high, the natural refrigerant flows on a third path from the compressor, to the gas cooler, to the high-pressure-side circuit of the inner heat exchanger, to the first opening/closing valve, to the first expansion valve, to the evaporator, to the fourth opening/closing valve, to the low-pressure-side circuit of the inner heat exchanger, and to the compressor, and the natural refrigerant flows from the high-pressure-side circuit of the inner heat exchanger to the second expansion valve, and to the liquid receiver, and a gas/liquid refrigerant flows from the liquid receiver to the compressor.

2. The refrigerating apparatus according to claim 1, wherein an intermediate portion between the inner heat exchanger and the second pressure reducing unit is connected to an intermediate portion between the liquid receiver and the first pressure reducing unit via the first opening/closing valve and a pipe.

3. The refrigerating apparatus according to claim 1, wherein the opening/closing degree of the second pressure reducing unit is controlled in accordance with the suction-side pressure of the compressor.

4. A refrigerating apparatus in which a multi-stage compressor, a gas cooler, a first pressure reducing unit and an evaporator are connected to one another via pipes and which is capable of operating with a natural refrigerant, the apparatus comprising:

a second pressure reducing unit and a liquid receiver between the gas cooler and the first pressure reducing unit, wherein the liquid receiver has a first outlet and a second outlet, a first pipe having a first opening/closing valve, wherein the first opening/closing valve has a first side and a second side, wherein the first side of the first opening/closing valve is directly connected to the first outlet of the liquid receiver, wherein the second side of the first opening/closing valve is directly connected to an intermediate pressure portion of the multi-stage compressor, and an inner heat exchanger having a high-pressure-side circuit and a low-pressure-side circuit, wherein the high-pressure-side circuit is disposed between the gas cooler and the second pressure reducing unit, wherein an outlet of the evaporator is connected to a suction port of the compressor via a second pipe and a second opening/closing valve, and is connected to the suction port of the multi-stage compressor via a third opening/closing valve and the low-pressure-side circuit of the inner heat exchanger, wherein a first intermediate portion directly connects the high-pressure-side circuit of the inner heat exchanger to the second pressure reducing unit, wherein a second intermediate portion directly connects the second outlet of the liquid receiver to the first pressure reducing unit, wherein the first intermediate portion is directly connected to a first side of a fourth opening/closing valve, wherein the second intermediate portion is directly connected to a second side of the fourth opening/closing valve, wherein a third intermediate portion is disposed to directly connect the outlet of the evaporator to a first side of the second opening/closing valve and to a first side of the third opening/closing valve, wherein a second side of the third opening/closing valve is directly connected to the low-pressure-side circuit of the inner heat exchanger, wherein a fourth intermediate portion is disposed to directly connect the low-pressure-side circuit of the inner heat exchanger to the suction port of the multi-stage compressor and to a second side of the second opening/closing valve, wherein the opening/closing degree of the second pressure reducing unit is controlled in accordance with a pressure difference between the discharge-side pressure of the multi-stage compressor and the suction-side pressure thereof, wherein the opening/closing degree of the second pressure reducing unit is controlled so that the pressure at the discharge-side pressure of the multi-stage compressor is a predetermined value or is less than the predetermined value, wherein, according to when refrigerating ability of the refrigerating apparatus is low, the natural refrigerant flows on a first path from the compressor, to the gas cooler, to the high-pressure-side circuit of the inner heat exchanger, to the second expansion valve, to the liquid receiver, to the first expansion valve, to the evaporator, and to the compressor, and a gas refrigerant flows from the liquid receiver to the compressor, wherein, according to when refrigerating ability of the refrigerating apparatus is normal, the natural refrigerant flows on a second path from the compressor, to the gas cooler, to the high-pressure-side circuit of the inner heat exchanger, to the first opening/closing valve, to the first expansion valve, to the evaporator, to the fourth opening/closing valve, to the low-pressure-side circuit of the inner heat exchanger, and to the compressor, wherein, according to when refrigerating ability of the refrigerating apparatus is high, the natural refrigerant flows on a third path from the compressor, to the gas cooler, to the high-pressure-side circuit of the inner heat exchanger, to the first opening/closing valve to the first expansion valve, to the evaporator, to the fourth opening/closing valve, to the low-pressure-side circuit of the inner heat exchanger, and to the compressor, and the natural refrigerant flows from the high-pressure-side circuit of the inner heat exchanger to the second expansion valve, and to the liquid receiver, and a gas/liquid refrigerant flows from the liquid receiver to the compressor.

5. The refrigerating apparatus according to claim 4, wherein the first intermediate portion between the high-pressure-side circuit of the inner heat exchanger and the second pressure reducing unit is connected to the second intermediate portion between the second outlet of the liquid receiver and the first pressure reducing unit via the fourth opening/closing valve.

6. The refrigerating apparatus according to claim 5, wherein the opening/closing degree of the second pressure reducing unit is controlled in accordance with the suction-side pressure of the multi-stage compressor.

7. The refrigerating apparatus according to claim 4, wherein the first intermediate portion between the inner heat exchanger and the second pressure reducing unit is connected to the second intermediate portion between the second outlet of the liquid receiver and the first pressure reducing unit via the fourth opening/closing valve.

8. The refrigerating apparatus according to claim 7, wherein the opening/closing degree of the second pressure reducing unit is controlled in accordance with the suction-side pressure of the multi-stage compressor.

9. The refrigerating apparatus according to claim 7, wherein the opening/closing degree of the second pressure reducing unit is controlled in accordance with a pressure difference between the discharge-side pressure of the multi-stage compressor and the suction-side pressure thereof.

10. The refrigerating apparatus according to claim 4, wherein the opening/closing degree of the second pressure reducing unit is controlled in accordance with the suction-side pressure of the multi-stage compressor.

11. The refrigerating apparatus according to claim 4, wherein the opening/closing degree of the second pressure reducing unit is controlled in accordance with a pressure difference between the discharge-side pressure of the multi-stage compressor and the suction-side pressure thereof.

* * * * *